US009520647B2

(12) United States Patent
Ito

(10) Patent No.: US 9,520,647 B2
(45) Date of Patent: Dec. 13, 2016

(54) VEHICLE MOUNTED ANTENNA DEVICE

(71) Applicant: Harada Industry Co., Ltd., Tokyo (JP)

(72) Inventor: Jun Ito, Tokyo (JP)

(73) Assignee: HARADA INDUSTRY CO., LTD., Tokyo (JP)

( * ) Notice: Subject to any disclaimer, the term of this patent is extended or adjusted under 35 U.S.C. 154(b) by 14 days.

(21) Appl. No.: 14/731,889

(22) Filed: Jun. 5, 2015

(65) Prior Publication Data

US 2015/0357705 A1 Dec. 10, 2015

(30) Foreign Application Priority Data

Jun. 6, 2014 (JP) ..... 2014-118224
Mar. 19, 2015 (JP) ..... 2015-055549

(51) Int. Cl.
*H01Q 1/32* (2006.01)
*H01Q 5/335* (2015.01)
*H01Q 1/36* (2006.01)

(52) U.S. Cl.
CPC ..... *H01Q 5/335* (2015.01); *H01Q 1/3283* (2013.01); *H01Q 1/36* (2013.01)

(58) Field of Classification Search
CPC ..... H01Q 1/3283; H01Q 1/36; H01Q 5/335
USPC ..... 343/713, 700 MS, 727, 704, 895
See application file for complete search history.

(56) References Cited

U.S. PATENT DOCUMENTS 6,072,435 A * 6/2000 Terashima ..... H01Q 1/1271 343/704
2003/0090423 A1* 5/2003 Horii ..... H01Q 3/242 343/727
2006/0132360 A1* 6/2006 Caimi ..... H01Q 1/243 343/700 MS
2007/0279287 A1* 12/2007 Castaneda ..... H01Q 1/2266 343/700 MS

FOREIGN PATENT DOCUMENTS

JP 2008-283609 A 11/2008
JP 2011-35519 A 2/2011
JP 2014-216661 A 11/2014

* cited by examiner

*Primary Examiner* — Peguy Jean Pierre
(74) *Attorney, Agent, or Firm* — Westerman, Hattori, Daniels & Adrian, LLP

(57) ABSTRACT

A vehicle mounted antenna device installed on a vehicle includes a circuit board, a main element portion, and an auxiliary element portion. The main element portion, which has a substantially planar shape, is disposed on substantially the same plane as the circuit board, functions also as a capacitive antenna designed for a first frequency band, and includes a bent pattern having an antenna capacity substantially equivalent to a solid pattern. The auxiliary element portion includes a distributed constant element portion that is connected in series between the main element portion and an amplifier circuit so as to complement shortage of an antenna length of the main element portion so that the antenna length of the main element portion is designed for a second frequency band. The distributed constant element portion is mounted on the circuit board and has an antenna capacity smaller than that of the main element portion.

12 Claims, 3 Drawing Sheets

VEHICLE MOUNTED ANTENNA DEVICE

BACKGROUND OF THE INVENTION

Field of the Invention

The present invention relates to a vehicle mounted antenna device and, particularly, to a vehicle mounted antenna device adaptive to a plurality of frequency bands and having such a flatness that it can be incorporated in a hollow body such as a spoiler or a backdoor.

Description of the Related Art

As antenna devices that are mounted on a vehicle and adaptive to a plurality of frequency bands (e.g., AM and FM frequency bands), there are various types of antenna devices, such as a pillar antenna, a roof mount antenna, and a glass antenna. However, the pillar antenna large in protrusion amount is highly likely to be bent due to contact or the like. Further, as for the roof mount antenna, attachment thereof to the roof of a vehicle increases a ground height of the vehicle, so that it is necessary to lay down or remove the roof mount antenna when the vehicle enters a multistory parking space or an automatic car washer. Further, the glass antenna needs to be developed uniquely for each vehicle type, resulting in high development cost. Further, importance is attached to design of the vehicle today and, accordingly, there is required a vehicle mounted antenna device that does not impair appearance of the vehicle as much as possible. Under such circumstances, there are developed various types of antennas that are incorporated in the spoiler so as not to impair the appearance of the vehicle.

For example, there exists an antenna device in which a monopole antenna element is disposed in a space inside the spoiler so as to extend both ends in a left-right direction of the vehicle. Further, Patent Document 1 discloses an antenna device in which an antenna adaptive to AM and FM frequency bands is incorporated in the spoiler. Further, Patent Document 2 also discloses an antenna device in which a radio antenna or a digital TV antenna is disposed in the spoiler.

CITATION LIST

Patent Document

[Patent Document 1] Japanese Patent Application Kokai Publication No. 2011-035519

[Patent Document 2] Japanese Patent Application Kokai Publication No. 2008-283609

In each of the above conventional antenna devices, the antenna is disposed at a center of the spoiler in the left-right direction with respect to a vehicle travel direction. Typically, a high-mount stop lamp is installed adjacent to the center of the spoiler. In this case, due to interference with the high-mount stop lamp, S/N characteristics of the antenna may deteriorate. Further, in a configuration using a sub-antenna, interconnection between a main antenna and the sub-antenna becomes an issue. Further, when the antenna element is disposed at the center of the spoiler in the left-right direction with respect to the vehicle travel direction, null may occur in directivity. Specifically, in the FM frequency band, null occurs in a vehicle front-back direction for a horizontally polarized wave and in a vehicle left-right direction for a vertically polarized wave. This causes a direction in which gain deteriorates, resulting that receiving accuracy may vary depending on a receiving direction.

The applicant has invented a substantially plane-arranged vehicle mounted antenna device in which a composite antenna element is arranged while being offset either to the right or left within a hollow body with respect to a vehicle travel direction and grounded in a metal portion of the vehicle adjacent to the arrangement position with a plane direction thereof inclined toward a side vertical to a metal body of a vehicle (see Japanese Patent Application No. 2013-089599 (Japanese Patent Application Kokai Publication No. 2014-216661)).

Nowadays, vehicle mounted antenna devices are required to achieve further reduction in size and cost.

SUMMARY OF THE INVENTION

In view of the above situation, an object of the present invention is to provide a vehicle mounted antenna device capable of achieving size reduction and capable of being manufactured at low cost.

To achieve the above object, a vehicle mounted antenna device according to the present invention includes: a circuit board on which an amplifier circuit is placed; a substantially planar shaped main element portion that is disposed on substantially the same plane as the circuit board, functions as a capacitive antenna designed for a first frequency band, and includes a bent pattern having an antenna capacity substantially equivalent to a solid pattern; and an auxiliary element portion that includes a distributed constant element portion that is connected in series between the main element portion and the amplifier circuit so as to complement shortage of an antenna length of the main element portion so that the antenna length of the main element portion is designed for a second frequency band, the distributed constant element portion being mounted on the circuit board and having an antenna capacity smaller than that of the main element portion.

The main element portion may be formed by processing a metal plate.

The main element portion may be formed by processing a conducting foil of a printed board or a flexible printed board.

The main element portion may have, at a side far from the vehicle, a wide pattern wider in line width than the bent pattern.

At least a part of the wide pattern of the main element portion may have a portion bent outside a plane of the substantially planar shaped main element portion.

The main element portion may include, as the bent pattern, at least one of a meander shaped pattern, a spiral shaped pattern, and a space-filling-curve shaped pattern.

The distributed constant element portion of the auxiliary element portion may be patterned in the circuit board.

A line width of the distributed constant element portion of the auxiliary element portion may be narrower than that of the bent pattern of the main element part.

The auxiliary element portion may further include a lumped constant element that is connected in series between the distributed constant element portion and the amplifier circuit so as to finely adjust the antenna length of the main element portion so that the antenna length of the main element portion is designed for the second frequency band, the lumped constant element being mounted on the circuit board and having an inductance smaller than that of the distributed constant element portion.

The vehicle mounted antenna device according to the present invention is advantageous in that it is capable of achieving size reduction and capable of being manufactured at low cost.

PREFERRED EMBODIMENTS OF THE INVENTION

Figure 1A:
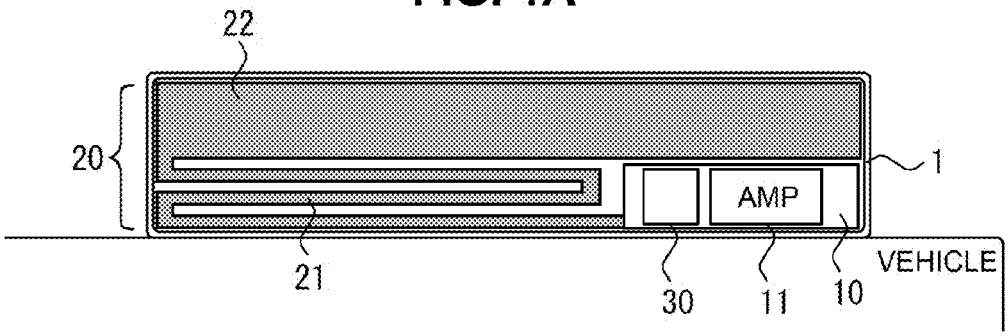
FIGS. 1A and 1B are each a schematic view for explaining a vehicle mounted antenna device according to the present invention.
Figure 1B:
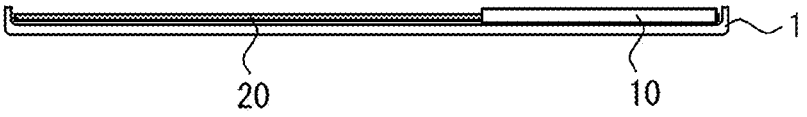

An embodiment for practicing the present invention will be described with reference to the accompanying drawings. FIGS. 1A and 1B are each a schematic view for explaining a vehicle mounted antenna device according to the present invention. FIG. 1A is a top view, and FIG. 1B is a side view. The present invention relates to a vehicle mounted antenna device installed on a vehicle. As illustrated, the vehicle mounted antenna device mainly includes a circuit board 10, a main element portion 20, and an auxiliary element portion 30. These components are housed in, e.g., a casing 1. The vehicle mounted antenna device according to the present invention may be incorporated in, e.g., a spoiler fixed to the vehicle. The spoiler is so-called an aero part, which is provided outside a vehicle body in terms of aerodynamics and design. The vehicle mounted antenna device of the present invention is not limited to one that is incorporated in the spoiler, but the vehicle mounted antenna device may be incorporated in any location where electric wave can be transmitted, that is, which is not covered by metal or the like. Specifically, the vehicle mounted antenna device may be incorporated in a hollow body such as a resin backdoor, a resin roof, or a resin trunk.

An amplifier circuit 11 is placed on the circuit board 10. The circuit board 10 may be a typical printed board and may be formed into a plate-like or film-like shape. The amplifier circuit 11 amplifies a receiving signal of the vehicle mounted antenna device. Specifically, the amplifier circuit 11 may be configured to amplify a signal of AM/FM frequency band and remove signal of other frequency bands by means of a filter.

The main element portion 20 is disposed on substantially the same plane as the circuit board 10. As illustrated, the main element portion 20 is disposed in the casing 1 in such a manner that heights of the main element portion 20 and the circuit board 10 are substantially the same. With this arrangement, reduction in size and thickness can be achieved. The main element portion 20 is formed into a substantially planar shape and functions also as a capacitive antenna designed for a first frequency band. The first frequency band refers to, e.g., an AM band of a radio receiver. The main element portion 20 includes a bent pattern 21 having an antenna capacity substantially equivalent to that of a solid pattern. The main element portion 20 illustrated in FIGS. 1A and 1B is obtained by processing a metal plate. That is, by applying press or sheet processing to the metal plate, a plate-like bent pattern is formed. In the vehicle mounted antenna device according to the present invention, the main element portion 20 may be configured to have a capacity large enough to function as a capacitive antenna. An antenna length of the main element portion 20 may be shorter than an antenna length designed for a second frequency band since the shortage can be complemented by the auxiliary element portion 30 to be described later. That is, the main element portion 20 can be roughly produced for cutting manufacturing costs so as to be able to produce at reduced cost so that the vehicle mounted antenna device can be made at a low cost. Further, when the main element portion 20 is formed by processing the metal plate, it is not necessary to separately prepare a base material of the main element portion 20. The present invention is not limited to this, but the main element portion 20 may be formed by processing a conducting foil of a printed board or a flexible printed board. That is, a main element portion having a desired pattern may be formed by etching the board.

In the illustrated example, the main element portion 20 has a meander shape as the bent pattern 21. However, the present invention is not limited to this, the bent pattern 21 may be formed into a shape having an antenna capacity substantially equivalent to a solid pattern, such as a spiral shape or a space-filling-curve shape. That is, the pattern may be formed into any shape as long as a line width of the element is wide to some extent and a space between lines is narrow to some extent. The solid pattern refers to a uniform pattern that covers the entire surface of an outer shape of the main element portion 20. Further, in the illustrated example, the main element portion 20 has a wide pattern 22 wider in line width than the bent pattern 21 at a side far from the vehicle. With this configuration, like a capacity-loaded type antenna, reduction in the antenna length, that is, miniaturization can be achieved. The vehicle mounted antenna device according to the present invention is configured such that the antenna capacity becomes gradually small from a side far from the vehicle to a side near the vehicle. That is, the wide pattern 22 having a wide line width is disposed at a leading end side (side far from the vehicle), and the bent pattern 21 having a narrow line width is disposed at a root side (side near the vehicle). With this configuration, a maximum antenna capacity is obtained for the first frequency band, while impedance matching is easily achieved for the second frequency band, resulting in minimum loss.

The auxiliary element portion 30 complements the shortage of the antenna length of the main element portion 20 so that the antenna length of the main element portion 20 is designed for the second frequency band. The second frequency band may be an FM frequency band of a radio receiver, a DAB (Digital Audio Broadcast), or an UHF (Ultra-High Frequency). The auxiliary element portion 30 is connected in series between the main element portion 20 and the amplifier circuit 11. The auxiliary element portion 30 includes a distributed constant element portion having an antenna capacity smaller than that of the main element portion 20. The auxiliary element portion 30 is provided on the circuit board 10. The main element portion 20 may be finely adjusted by the auxiliary element portion 30 so as to have an antenna length designed for the second frequency band.

The distributed constant element portion has a bent pattern of, e.g., a meander shape, a spiral shape, or a space-filling-curve shape. The auxiliary element portion 30 is formed on the circuit board 10 so as to have the distributed constant element portion having such a pattern.

In the thus configured vehicle mounted antenna device according to the present invention, a maximum antenna capacity is obtained for the first frequency band, while impedance matching is easily achieved for the second frequency band, resulting in minimum loss.

Figure 2:
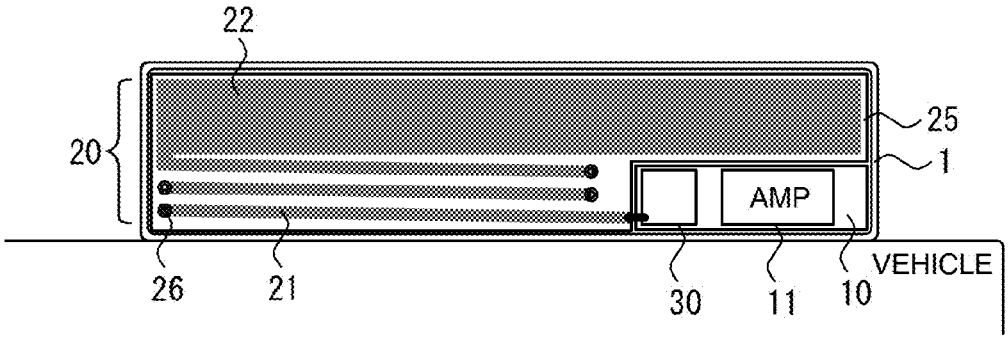
FIG. 2 is a schematic top view for explaining an example in which a main element portion of the vehicle mounted antenna device according to the present invention is formed using a printed board.

The another example of the main element is described as follows. FIG. 2 is a schematic top view for explaining an example in which the main element portion of the vehicle mounted antenna device according to the present invention is formed using a printed board. In FIG. 2, the same reference numerals as those in FIGS. 1A and 1B denote the same parts as those in FIGS. 1A and 1B. As illustrated, the main element portion 20 is formed into a desired pattern by etching a conducting foil on a printed board 25. In the illustrated example, the bent pattern 21 has a spiral shape. That is, the printed board 25 is a double-side printed board, and predetermined patterns on both front and back surfaces are connected through a through hole 26, whereby the spiral shape is obtained. Also in this case, the bent pattern 21 is configured so as to have an antenna capacity substantially equivalent to that of the solid pattern.

In the illustrated example, the printed board 25 and the circuit board 10 separately provided. With this configuration, the printed board 25 for the main element portion can be variously altered in accordance with a size or a shape of the hollow body such as the spoiler, thereby enhancing versatility. This further allows replacement of only the circuit board 10 on which the amplifier circuit 11 is placed, thereby enhancing maintainability. Further, soldering of parts onto the circuit board 10 may be performed only for the circuit board 10 separately provided from the large-sized printed board 25 for antenna, thereby improving productivity and enhancing yield. The circuit board or printed board may be a flexible board formed of a film-like board.

Figure 3:
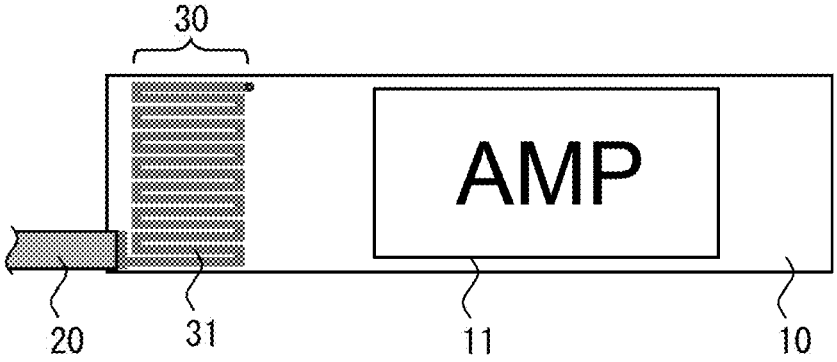
FIG. 3 is a schematic top view of a circuit board for explaining an example of an auxiliary element portion of the vehicle mounted antenna device according to the present invention.

FIG. 3 is a schematic top view of a circuit board for explaining an example of the auxiliary element portion of the vehicle mounted antenna device according to the present invention. In FIG. 3, the same reference numerals as those in FIGS. 1A and 1B and FIG. 2 denote the same parts as those in FIGS. 1A and 1B and FIG. 2. In the illustrated example, a distributed constant element portion 31 of the auxiliary element portion 30 is patterned on the circuit board 10. Specifically, the auxiliary element portion 30 has a meander shape. Thus, the auxiliary element portion 30 may be formed into a bent pattern like a distributed constant element. A line width of the distributed constant element portion 31 is narrower than the line width of the bent pattern 21 of the main element portion 20. With this configuration, the antenna capacity becomes gradually small from the side far from the vehicle to side near the vehicle.

Figure 4:
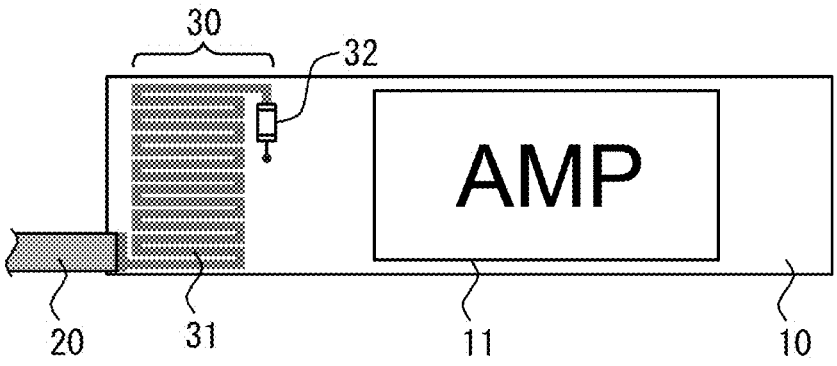
FIG. 4 is a schematic top view of a circuit board for explaining another example of the auxiliary element portion of the vehicle mounted antenna device according to the present invention.

FIG. 4 is a schematic top view of a circuit board for explaining another example of the auxiliary element portion of the vehicle mounted antenna device according to the present invention. In FIG. 4, the same reference numerals as those in FIGS. 1A and 1B to FIG. 3 denote the same parts as those in FIGS. 1A and 1B to FIG. 3. In the illustrated example, the auxiliary element portion 30 further includes a lumped constant element. Specifically, a chip coil 32 is used as the lumped constant element. In the illustrated example, the distributed constant element portion 31 which is the distributed constant element and the chip coil 32 are combined. The chip coil 32 which is the lumped constant element is used to finely adjust the antenna length of the main element portion 20 so that the antenna length of the main element portion 20 is designed for the second frequency band. The chip coil 32 is connected in series between the distributed constant element portion 31 and the amplifier circuit 11 and mounted on the circuit board 10. The chip coil 32 has an inductance smaller than that of the distributed constant element portion 31. Also in this example, a line width of the chip coil is very narrow, resulting that the antenna capacity becomes gradually small from the side far from the vehicle to side near the vehicle. Although the auxiliary element portion 30 is constituted by a combination of the distributed constant element portion 31 and the chip coil 32 in the illustrated example, the present invention is not limited to this, but only the chip coil 32 may be used to finely adjust the antenna length of the main element portion 20.

Figure 5:
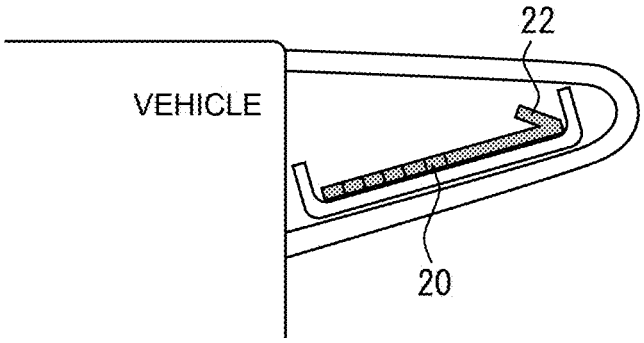
FIG. 5 is a schematic side view for explaining another example of the vehicle mounted antenna device according to the present invention.

FIG. 5 is a schematic side view for explaining another example of the vehicle mounted antenna device according to the present invention. In FIG. 5, the same reference numerals as those in FIGS. 1A and 1B to FIG. 4 denote the same parts as those in FIGS. 1A and 1B to FIG. 4. There may be a case where the main element portion needs to be formed in a smaller size due to restrictions in terms of a size or a shape of the hollow body such as the spoiler. In this case, as illustrated, in the vehicle mounted antenna device according to the present invention, a part of the wide pattern 22 of the main element portion 20 may be bent outside a plane of the substantially planar shaped main element portion 20. Specifically, a part of the wide pattern 22 at a side far from the vehicle is folded back upward. This allows the vehicle mounted antenna device according to the present invention to be housed even in a spoiler small in protrusion amount, thereby achieving a vehicle mounted antenna device with high adaptability.

Figure 6:
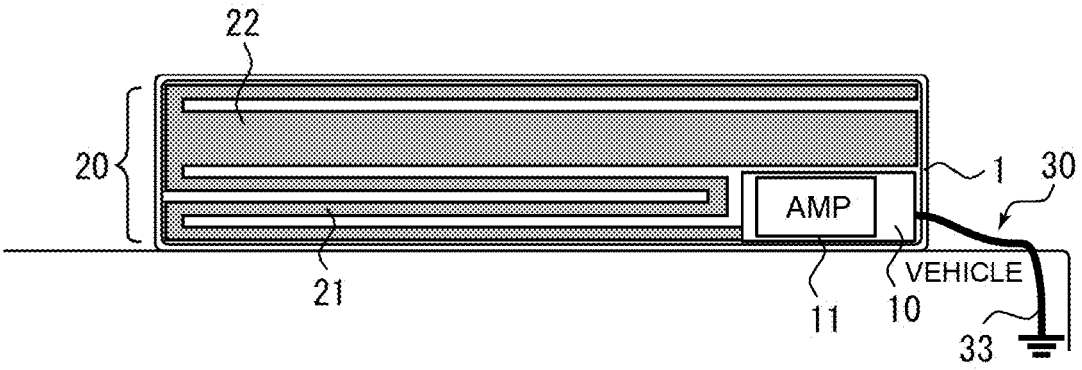
FIG. 6 is a schematic top view for explaining still another example of the auxiliary element portion of the vehicle mounted antenna device according to the present invention.

In the above-described examples, the distributed constant element as the auxiliary element portion is connected in series between the main element portion and the amplifier circuit. However, the present invention is not limited to this. FIG. 6 is a schematic top view for explaining still another example of the auxiliary element portion of the vehicle mounted antenna device according to the present invention. In FIG. 6, the same reference numerals as those in FIGS. 1A and 1B to FIG. 5 denote the same parts as those in FIGS. 1A and 1B to FIG. 5. In the illustrated example, a body ground cable 33 is used as the auxiliary element portion 30. Specifically, the body ground cable 33 has an antenna capacity smaller than that of the main element portion 20. The body ground cable 33 is connected in series between the amplifier circuit 11 and vehicle body. The body ground cable 33 itself functions as an antenna, so that it may be configured such that the antenna length of the main element portion 20 is designed for the second frequency band.

In the illustrated example, the wide pattern 22 is provided not at a side farthest from the vehicle but at an intermediate portion between a side nearest the vehicle and the side farthest from the vehicle.

Figure 7:
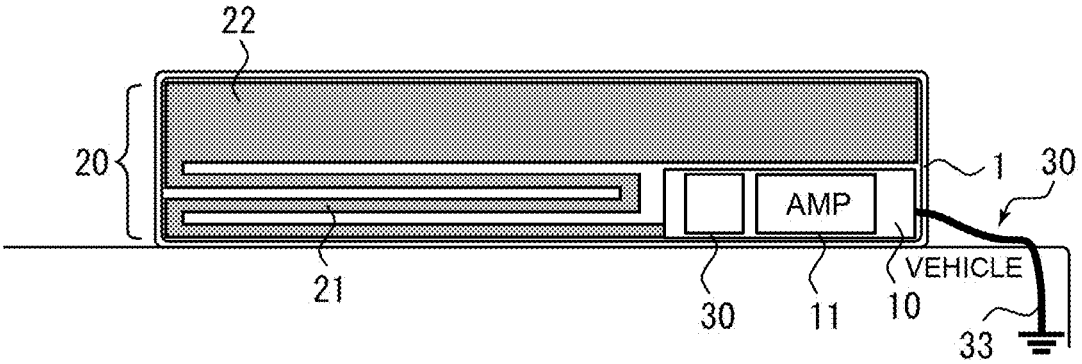
FIG. 7 is a schematic top view for explaining still another example of the auxiliary element portion of the vehicle mounted antenna device according to the present invention.

Although the distributed constant element portion is not connected between the main element portion and the amplifier circuit in the example of FIG. 6, the present invention is not limited to this. That is, a configuration obtained by combining the configurations illustrated in FIGS. 1A and 1B and FIG. 6 may be available. FIG. 7 is a schematic top view for explaining still another example of the auxiliary element portion of the vehicle mounted antenna device according to the present invention. In FIG. 7, the same reference numerals as those in FIGS. 1A and 1B to FIG. 6 denote the same parts as those in FIGS. 1A and 1B to FIG. 6. In the illustrated example, the auxiliary element portion 30 includes the distributed constant element portion 31 connected in series between the main element portion 20 and the amplifier circuit 11 and the body ground cable 33 connected in series between the amplifier circuit 11 and vehicle body. The shortage of the antenna length of the main element portion 20 may be complemented so that the antenna length of the main element portion 20 is designed for the second frequency band by combining the lengths of the distributed constant element portion 31 and the body ground cable 33.

Figure 8:
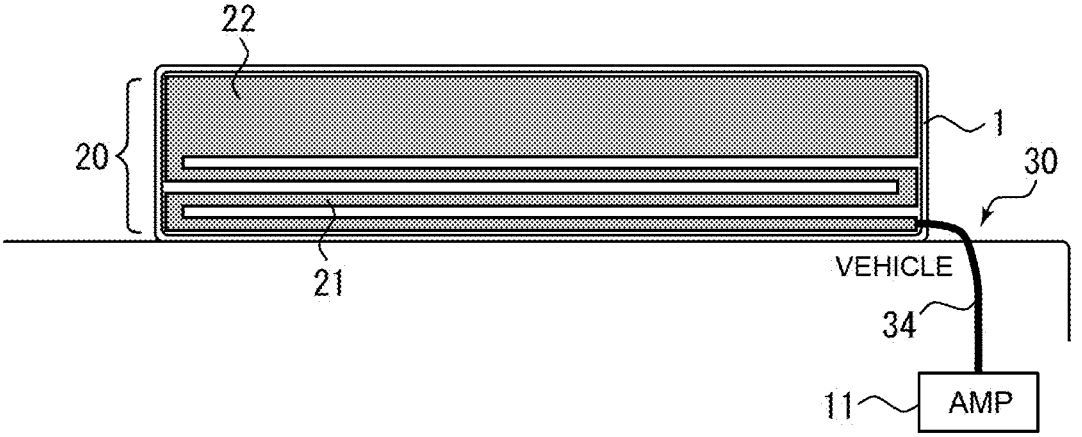
FIG. 8 is a schematic top view for explaining still another example of the auxiliary element portion of the vehicle mounted antenna device according to the present invention.

In the above examples, the amplifier circuit is placed on the circuit board. However, the present invention is not limited to this. FIG. 8 is a schematic top view for explaining still another example of the auxiliary element portion of the vehicle mounted antenna device according to the present invention. In FIG. 8, the same reference numerals as those in FIGS. 1A and 1B to FIG. 3 denote the same parts as those in FIGS. 1A and 1B to FIG. 7. In the illustrated example, a low voltage cable 34 is used as the auxiliary element portion 30. Specifically, the low voltage cable 34 has an antenna capacity smaller than that of the main element portion 20. The low voltage cable 34 is connected in series between the main element portion 20 and the amplifier circuit 11. The low voltage cable 34 itself functions as an antenna, so that it may be configured such that the antenna length of the main element portion 20 is designed for the second frequency band. The auxiliary element may be constituted by appropriately combining configuration of FIG. 8 with the configuration of FIGS. 1A and 1B, FIG. 6, or FIG. 7.

The vehicle mounted antenna device according to the present invention is not limited to the illustrated examples described above, but various modification may be made within the scope of the present invention.

What is claimed is:

1. A vehicle mounted antenna device installed on a vehicle, comprising:

a circuit board on which an amplifier circuit is placed;

a substantially planar shaped main element portion that is disposed on substantially the same plane as the circuit board, functions as a capacitive antenna designed for a first frequency band, and includes a bent pattern having an antenna capacity substantially equivalent to a solid pattern; and an auxiliary element portion that includes a distributed constant element portion connected in series between the main element portion and the amplifier circuit so as to complement shortage of an antenna length of the main element portion so that the antenna length of the main element portion is designed for a second frequency band, the distributed constant element portion being mounted on the circuit board and having an antenna capacity smaller than that of the main element portion.

2. The vehicle mounted antenna device according to claim 1, wherein the distributed constant element portion of the auxiliary element portion is patterned in the circuit board.

3. The vehicle mounted antenna device according to claim 2, wherein a line width of the distributed constant element portion of the auxiliary element portion is narrower than that of the bent pattern of the main element portion.

4. The vehicle mounted antenna device according to claim 1, wherein the auxiliary element portion further includes a lumped constant element that is connected in series between the distributed constant element portion and the amplifier circuit so as to finely adjust the antenna length of the main element portion so that the antenna length of the main element portion is designed for the second frequency band, the lumped constant element being mounted on the circuit board and having an inductance smaller than that of the distributed constant element portion.

5. The vehicle mounted antenna device according to claim 1, wherein the auxiliary element portion further includes a body ground cable that is connected in series between the amplifier circuit and a vehicle body so as to finely adjust the antenna length of the main element portion so that the antenna length of the main element portion is designed for the second frequency band, the body ground cable having an antenna capacity smaller than that of the main element portion.

6. The vehicle mounted antenna device according to claim 1, wherein the main element portion is formed by processing a metal plate.

7. The vehicle mounted antenna device according to claim 1, wherein the main element portion is formed by processing a conducting foil of a printed board or a flexible printed board.

8. The vehicle mounted antenna device according to claim 1, wherein the main element portion has, at a side far from the vehicle, a wide pattern wider in line width than the bent pattern.

9. The vehicle mounted antenna device according to claim 8, wherein at least a part of the wide pattern of the main element portion has a portion bent outside a plane of the substantially planar shaped main element portion.

10. The vehicle mounted antenna device according to claim 1, wherein the main element portion includes, as the bent pattern, at least one of a meander shaped pattern, a spiral shaped pattern, and a space-filling-curve shaped pattern.

11. A vehicle mounted antenna device installed on a vehicle, comprising:

a circuit board on which an amplifier circuit is placed;

a substantially planar shaped main element portion that is disposed on substantially the same plane as the circuit board, functions also as a capacitive antenna designed for a first frequency band, and includes a bent pattern having an antenna capacity substantially equivalent to a solid pattern; and an auxiliary element portion that includes a body ground cable that is connected in series between the amplifier circuit and a vehicle body so as to complement shortage of an antenna length of the main element portion so that the antenna length of the main element portion is designed for a second frequency band, the body ground cable having an antenna capacity smaller than that of the main element portion.

12. A vehicle mounted antenna device installed on a vehicle, comprising:

an amplifier circuit installed on the vehicle;

a substantially planar shaped main element portion that functions also as a capacitive antenna designed for a first frequency band and includes a bent pattern having an antenna capacity substantially equivalent to a solid pattern; and an auxiliary element portion that includes a low voltage cable that is connected in series between the main element portion and the amplifier circuit so as to complement shortage of an antenna length of the main element portion so that the antenna length of the main element portion is designed for a second frequency band, the low voltage cable having an antenna capacity smaller than that of the main element portion.

* * * * *